US008267604B2

(12) United States Patent
Conway et al.

(10) Patent No.: US 8,267,604 B2
(45) Date of Patent: Sep. 18, 2012

(54) SHEET DISCHARGE ASSEMBLY FOR A PRINTER

(75) Inventors: William Elias Conway, Smyrna, GA (US); James Jonathan Holbrook, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 581 days.

(21) Appl. No.: 12/500,267

(22) Filed: Jul. 9, 2009

(65) Prior Publication Data

US 2010/0008710 A1 Jan. 14, 2010

Related U.S. Application Data

(60) Provisional application No. 61/079,587, filed on Jul. 10, 2008.

(51) Int. Cl.

| | |
|---|---|
| ***B41J 29/02*** | (2006.01) |
| ***B41J 29/00*** | (2006.01) |
| ***B65H 29/70*** | (2006.01) |
| ***B65H 29/52*** | (2006.01) |

(52) U.S. Cl. ..... 400/621; 400/645

(58) Field of Classification Search ..... 400/645, 400/645.4, 621; 271/188, 209

See application file for complete search history.

(56) References Cited

U.S. PATENT DOCUMENTS

| | | | | |
|---|---|---|---|---|
| 3,942,786 | A | 3/1976 | Lauren | |
| 4,346,881 | A | 8/1982 | Frye | |
| 4,667,949 | A | 5/1987 | Goodwin et al. | |
| 5,199,700 | A | 4/1993 | Fairey et al. | |
| 5,879,004 | A | 3/1999 | Cote et al. | |
| 6,634,852 | B2 | 10/2003 | Bakoledis | |
| 6,698,752 | B1 | 3/2004 | Kakuta et al. | |
| 7,731,437 | B2 * | 6/2010 | Shirotori et al. | 400/621 |

FOREIGN PATENT DOCUMENTS

| | | | |
|---|---|---|---|
| JP | 62105857 A | * | 5/1987 |
| JP | 11043252 A | * | 2/1999 |
| JP | 2001253613 A | * | 9/2001 |
| JP | 2006225097 A | * | 8/2006 |

OTHER PUBLICATIONS http://www.scientificgames.com/sections/lottery-systems/lottery-terminals.aspx (WAVE), Jun. 2008.

* cited by examiner

*Primary Examiner* — Daniel J Colilla
(74) *Attorney, Agent, or Firm* — Dority & Manning, P.A.

(57) ABSTRACT

A printer for printing individual sheets from a continuous feed roll includes a housing configured for receipt of a feed roll of sheet material, and a print mechanism disposed within the housing, whereby the sheet material is conveyed within the housing to print mechanism. A sheet separating device is disposed within the housing downstream of the print mechanism to separate the sheet material into individual printed sheets. A discharge assembly is disposed downstream of the sheet separating device and defines a gap through which the sheet material is advanced. At least one protruding member is disposed in the gap at a position so as to contact and deflect the sheet material and to impart a curved transverse profile to a trailing edge of a first individual sheet held in the gap. In this manner, a leading edge of a subsequent sheet bisects the curved trailing edge of the first sheet and pushes the first sheet out of the gap as the second sheet is advanced through the print mechanism.

12 Claims, 4 Drawing Sheets

SHEET DISCHARGE ASSEMBLY FOR A PRINTER

PRIORITY CLAIM

The present application claims priority to U.S. Provisional Application Ser. No. 61/079,587, filed Jul. 10, 2008.

FIELD OF THE INVENTION

The present invention relates to an assembly for discharging individual sheets from a printer, wherein the sheets are printed and cut from a continuous feed roll.

BACKGROUND

Printers configured to print and cut individual tickets, labels, coupons, and the like from a continuous feed roll are well known in the art. Conventional uses of such printers include cash registers, coupon printers, label printers, and the like. Although the printing mechanism, drive configuration, and sheet cutting mechanism may vary widely between different printers, eventually each sheet must be cut after printing and advanced to a discharge position wherein the sheet is presented for removal from the printer, generally in a discharge tray or similar component. This process is typically accomplished by a motor and drive system wherein the sheet is engaged by a frictional drive wheel or other member that is driven by a motor. A discharge chute may also be provide having spring elements that engage and guide the sheet as it is advanced into the tray.

Such printers have gained wide acceptance in the lottery industry, and are typically incorporated into individual lottery terminals provided to vendors for administering online lottery games. For example, Scientific Games International, Inc. offers a line of lottery terminals under the tradename "Extrema" that include thermal printers for printing individual lottery tickets directly at the terminal. The Extrema MX model is a modular unit that utilizes a separate clamshell-load thermal printer that can be located away from the terminal.

The conventional printers discussed above that incorporate motor driven discharge systems are relatively complicated and add significantly to the overall cost of the printers. Also, such systems can be prone to jamming, and may be difficult to troubleshoot and repair.

The present invention provides a unique and relatively simple discharge assembly for printers that eliminates motor driven components, is less susceptible to mechanical problems, and is easy to troubleshoot and repair.

SUMMARY OF THE INVENTION

Objects and advantages of the invention will be set forth in part in the following description, or may be obvious from the description, or may be learned through practice of the invention.

A printer is provided that may have usefulness in a wide variety of applications wherein it is desired to print individual sheets, such as tickets, labels, coupons, and the like, from a continuous feed roll. In a unique embodiment, the printer is well suited as a lottery ticket printer, either as a stand-alone unit or incorporated with a lottery ticket terminal. It should be appreciated, however, that the printer is not limited by its particular use.

The printer includes a housing having any desired shape, configuration, appearance, and so forth. The housing may be a component of a larger terminal in which the printer is configured, or may be a stand-alone housing structure. Thus, the housing may be considered as any structure in which the printer components are operationally configured.

The housing is configured for receipt therein of a roll of continuous sheet material of any desired type, such as paper, ribbon, or any other suitable printable material. For example, the roll of sheet material may be a paper stock that is suited for cash register printing, lottery ticket printing, coupon printing, and so forth.

Any manner of conventional print mechanism is disposed within the housing, and is feed the sheet material from the roll via a drive system. The type of print mechanism and associated drive system for feeding the sheet material are not limiting factors of the invention, and it should be appreciated that any manner of known print mechanism and drive system may be used. For example, the print mechanism may be a thermal or inkjet print mechanism, and the drive system may include any combination of motors, drive rolls, idler rolls, and guide structure.

The printer also includes a sheet separating device disposed within the housing downstream of the print mechanism to separate the printed sheet material into individual sheets. This separating device may be any manner of cutter, knife, blade, serrated edge, and so forth, conventionally used in printers to sever sheet material from a continuous supply. Such devices are well known and widely used in the art, and the present invention is not limited to any particular type of sheet separating device.

A discharge assembly is disposed downstream of the sheet separating device, and defines a gap extending across the conveying path of the sheet material through which the sheet material is advanced. The discharge assembly may include any manner of structure configured as a part or section of the housing, or added onto the housing. At least one protruding member is disposed in the gap. This member has a shape and size, and is positioned within the gap, so as to contact and deflect the sheet material as the material moves through the gap in a manner that imparts a curved transverse profile to the sheet material. After the indicia for an individual sheet has been printed by the print mechanism, the sheet material is advanced by the drive system until the desired end of an individual sheet is positioned at the cutting or separating device, wherein the material is separated to define an individual sheet (referred to herein as a "ticket"). In this process, the leading end and a substantial portion of the ticket are advanced through the gap, and a trailing portion of the ticket is held in the gap with the trailing edge of the ticket positioned at the separating device. After the cutting operation, the separated ticket is held in the gap, and the trailing edge of the ticket is separated from the leading edge of the next or subsequent ticket.

The protruding member in the gap imparts the curved transverse profile to the trailing edge of the first ticket held in the gap, and this profile is presented to the leading edge of the next ticket, which has an essentially straight-line profile. The leading edge of the second ticket thus bisects the curved trailing edge of the first ticket and, as the second ticket is advanced through the print mechanism, this leading edge engages the trailing edge of the first ticket and pushes the first ticket out of the gap. The first ticket may fall into a tray, or any other suitable structure for accumulating or further processing of the tickets.

In a unique embodiment, the discharge assembly includes a first member and a second opposed member, with the gap defined between the members. The members may be configured in a clamshell configuration with one or more protruding members configured on one or both of the members. The members may be biased towards each other. For example, one or both of the members may be spring-loaded or biased towards the gap. One of the members may be stationary, while the other member is positively biased towards the gap. The biased member may be spring-biased, or may simply be biased by gravity. The relative bias of the members ensures that, after separation from the sheet material, the trailing portion of the first ticket is held between the members and engaged by the protruding member so as to impart the curved profile to the trailing edge of the first ticket.

In the embodiment wherein the gap is defined by first and second members, one of the members may be a cover that moves from a closed position to an open position relative to the other member, which may be a portion of the housing or a member separate from the housing. One or more protruding members may be provided on the underside of the cover. The cover may be used to provide access to the gap for threading the sheet material prior to printing, troubleshooting, or any other reason.

In various embodiments, a plurality of the protruding members may be spaced apart and extend into the gap. For example, at least one protruding member may be disposed on a stationary member, and at least one protruding members may be disposed on an opposite member that is biased towards the stationary member, such as in a clamshell arrangement. The protruding members may be disposed so as to impart a serpentine or sinusoidal transverse profile to the trailing edge of the first ticket.

In a unique embodiment, a plurality of the protruding members may be defined on a rotatable bar or rod, which is in turn biased into the gap. In an alternate embodiment, the individual protruding members may be mounted onto a stationary member and individually biased towards the gap.

DETAILED DESCRIPTION

Figure 1A:
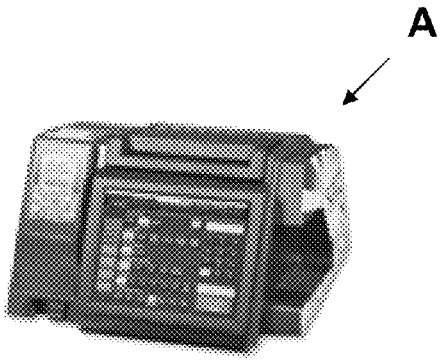
Fig. 1A Prior Art
FIGS. 1A through 1C are pictures of prior art lottery terminal printers from SCI International, Inc.

Reference will now be made in detail to embodiments of the method and system according to the invention, particular examples of which are illustrated in the drawings. Each embodiment is provided by way of explanation of the invention, and not meant as a limitation of the invention. For example, features illustrated or described with respect to one embodiment may be used with another embodiment to yield still a further embodiment. It is intended that the invention include these and other modifications and variations to the embodiments illustrated and described herein as come within the scope and spirit of the invention.

Figure 1B:
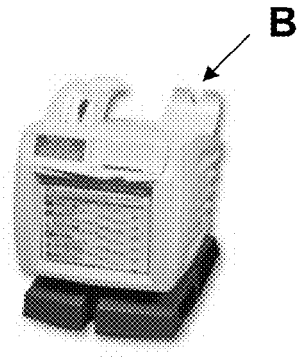
Fig. 1B Prior Art
Figure 1C:
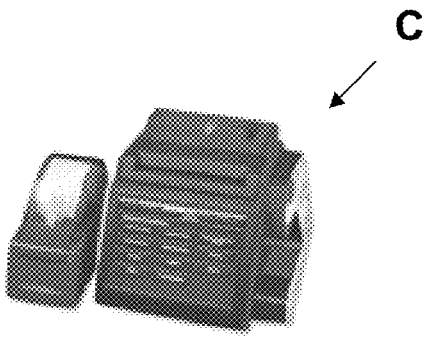
Fig. 1C Prior Art

FIGS. 1A through 1C are illustrations of prior art lottery terminals that incorporate printers. The present invention is particularly well suited for incorporation with any manner of conventional lottery ticket terminal, and FIGS. 1A through 1C are provided for reference and to place a printer in accordance with the present invention in a preferred environment. FIG. 1A is an illustration of an EXTREMA IX lottery terminal "A" from Scientific Games International, Inc. This terminal incorporates an auto-load thermal printer with the other terminal functionalities. FIG. 1B is a picture of the EXTREMA CX terminal "B" from Scientific Games that also incorporates an internal printer. FIG. 1C is an illustration of the EXTREMA MX terminal "C" from Scientific Games that utilizes a modular clamshell-load thermal printer that is separate from the terminal housing. A printer configured in accordance with aspects of the present invention may be utilized with any of the lottery terminals illustrated in FIGS. 1A through 1C, or any other type of lottery terminal.

Although the printer in accordance with the invention is well suited as a lottery ticket printer, either as a stand-alone unit or incorporated with a lottery ticket terminal, it should be appreciated that the printer is not limited to this particular use. A printer in accordance with the invention may be configured with any manner of device, or as a stand-alone unit, for any desired printing application wherein individual sheets, tickets, coupons, and the like are printed from a continuous feed roll.

Figure 2:
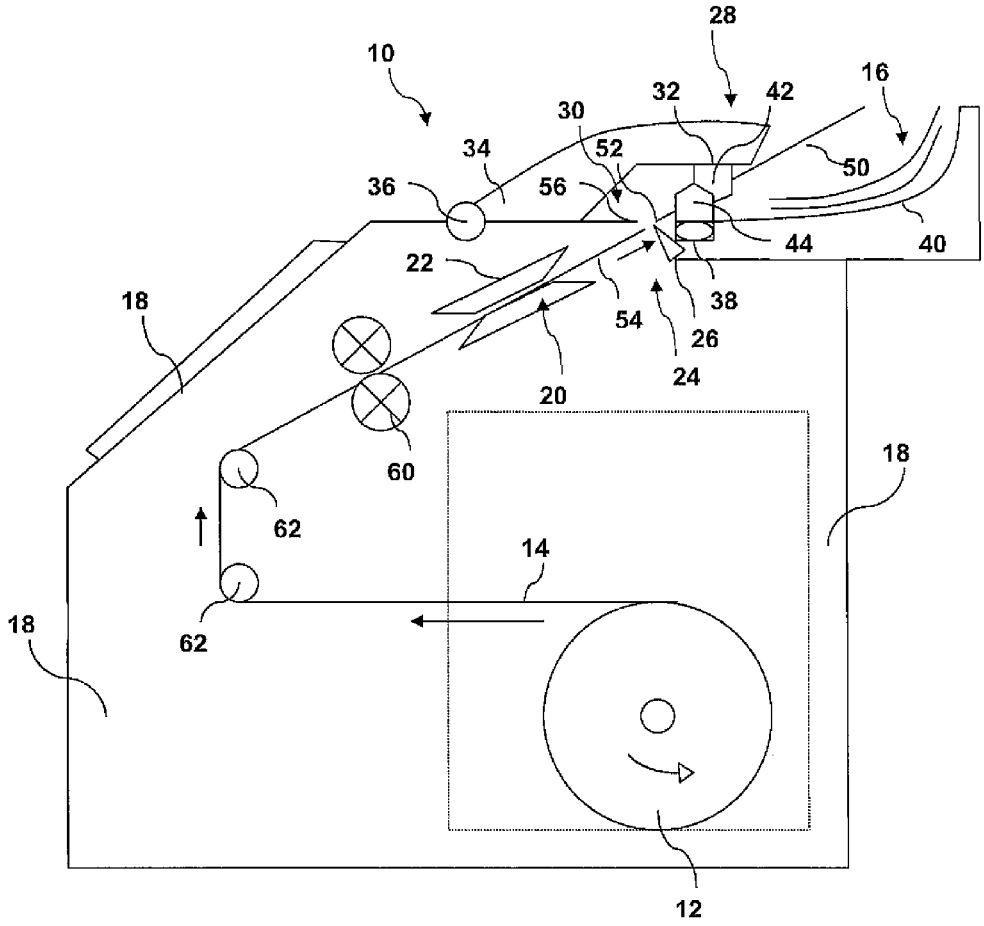
FIG. 2 is a diagrammatic view of an embodiment of a printer terminal in accordance with aspects of the invention.

FIG. 2 is a basic diagram view of a printer 10 illustrating certain general operational features and characteristics. The printer 10 includes a housing 18, which may be any configuration of structure, such as walls and the like, in which a printer is supported and configured. The housing 18 may include components of a larger terminal, or may constitute a stand-alone structure. The housing 18 can be configured in any desired shape or aesthetic configuration, and may be formed of any manner of conventional materials.

The housing 18 is configured for receipt of a roll 12 of sheet material 14. The roll 12 is preferably seated within a space within the housing 18, with the sheet material 14 being threaded through or around any manner of idler rolls 62, or other guide structure, in a conveying path through the housing 18. In a particular embodiment, the roll 12 is a roll of paper stock sheet material that is suited for cash register printing, lottery ticket printing, coupon printing, and so forth. It should be appreciated that the printer is not limited by the particular type of printable medium supplied thereto.

Any manner of conventional print mechanism 20 is configured in the housing 18. The print mechanism 20 may be, for example, a thermal print mechanism, an ink jet print mechanism, and the like. Desirably, the print mechanism 20 may be any manner of print mechanism used in lottery ticket terminals, or stand-alone lottery ticket printers. It should be appreciated that the printer 10 is not limited by any particular type of print mechanism. In the generic embodiment illustrated in FIG. 2, the print mechanism 20 includes thermal print heads 22 for printing on both sides of the sheet material 14.

Any manner of drive system may be utilized for conveying the sheet material 14 through the print mechanism 20 to downstream components. For example, in the illustrated embodiment, motor driven drive rolls 60 frictionally engage the sheet material 14 and pull the material from the roll 12 and convey the material through the print mechanism 20. Additional drive rolls, or other type of drive component, may be disposed on the downstream side of the print mechanism 20 to aid in further conveyance of the sheet material 14 through the printer. A suitable drive system may include any combination of motors, drive rolls, idler rolls, and guide structure configured to convey the sheet material in a conveying path through the printer 10.

A sheet separating device 24 is disposed downstream of the print mechanism 20 to separate the printed sheet material into an individual printed sheet 50. The individual printed sheets are referred to generically herein as "tickets." It should be appreciated that the term "tickets" is used for sake of reference to identify individual sheets that have been separated from the continuous supply of sheet material, and that the printer is not limited to the printing of tickets per se, such as lottery tickets, event tickets, and so forth. The separating device 24 may be any manner of knife or blade 26 that is automatically actuated to separate the sheet material along a line that designates the end of an individual ticket 50. This line defines the trailing edge 52 of a first ticket 50, and the leading edge 56 of the next or subsequent ticket 54.

Still referring to FIG. 2, a discharge assembly 28 is disposed downstream of the sheet separating device 26. The discharge assembly may include any configuration of structure that is a part or portion of the housing 18, or that is added onto the housing 18. The discharge structure 28 defines a gap 30 through which the sheet material 14 is conveyed and held for separation by the device 26. The gap 30 may be defined by any structure of the discharge assembly 28.

At least one protruding member 42 or 44 is disposed in the gap 30, and has a shape and a size so as to contact and deflect the sheet material 14 as the material moves through the gap 30. The protruding member contacts and deflects the sheet material so as to impart a curved transverse profile to the material, particularly to the trailing edge 52 of the ticket 50 after the separation step. After the desired indicia for an individual ticket or sheet has been printed on the material 14 by the print mechanism 20, the sheet material is advanced by the drive system until the desired separation line is positioned at the separation device 26 wherein, as discussed, a trailing edge 52 is defined for a first ticket 50, and a leading edge 56 is defined for a second or subsequent ticket 54. After the separation process, the separated ticket 50 is held in the gap 30 so that the trailing edge 52 of the ticket 50 is adjacent to the leading edge 56 of the next ticket 54. The leading edge 56 assumes an essentially straight-line transverse profile after the separation process, and thus bisects the curved profile of the trailing edge 52 of the ticket 50. As the subsequent ticket 54 is printed and advanced to the separation device, the leading edge 56 engages the trailing edge 52 and pushes the first ticket 50 through the gap 30. The ticket 50 may be received in any conventional structure, such as a discharge tray 40 wherein a stack 16 of the tickets may accumulate.

It should be appreciated that, as the leading edge 56 of the subsequent ticket 54 advances and pushes against the trailing edge 52 of the first ticket 50, the leading edge 56 and a portion of the ticket 54 will assume a curved transverse profile as the ticket 54 is contacted and deflected by the protruding member or members 42, 44. However, as the leading edge 56 assumes this profile, the trailing edge 52 loses its curved profile as it disengages from the protruding members 42, 44. As the trailing edge 52 flattens out, the leading edge 56 will eventually disengage from the trailing edge 52 and slide over the ticket 50. This occurs essentially as the ticket 50 disengages from between the protruding member or members 42, 44. At this point, the ticket 50 is free to fall into the tray 40 while the second ticket 54 continues its advancement into the gap 30.

The discharge assembly 28 may, in a unique embodiment, include a first member 32 and a second opposed member 38, with the gap 30 defined between the members. The members 32 and 38 are not limited by their shape or design, and in a particular embodiment are configured in a clamshell configuration with a protruding member 42, 44 configured on one or both of the members. The members 32, 38 encompass any manner or combination of structure for supporting the protruding the members 42, 44. One or both of the members 32, 38 may be biased into the gap 30. For example, any manner of conventional spring or torsion device 36 may be used to bias the first member 32 at a pivot point generally, as represented by the spring 36 in FIG. 2. In this embodiment, the first member 32 is thus movable and biased into the gap, while the second member 38 is stationary. In an alternative embodiment, one of the members 32, 38 may be biased by gravity into the gap 30. The relative bias between the first and second members ensures that, after separation of the first ticket 50, a trailing portion of the first ticket is held between the members and engaged by the protruding members 42, 44, so as to impart the curved transverse profile to the trailing edge 52 of the ticket 50.

In the embodiment wherein the gap 30 is defined by first and second members 32, 38, one of the members, such as member 32 illustrated in FIG. 2 may be a cover that moves from a closed position to an opened position relative to the other member. This cover may be a portion of the housing 18, or a member that is separate from the housing but pivotal relative to the housing 18.

Figure 3:
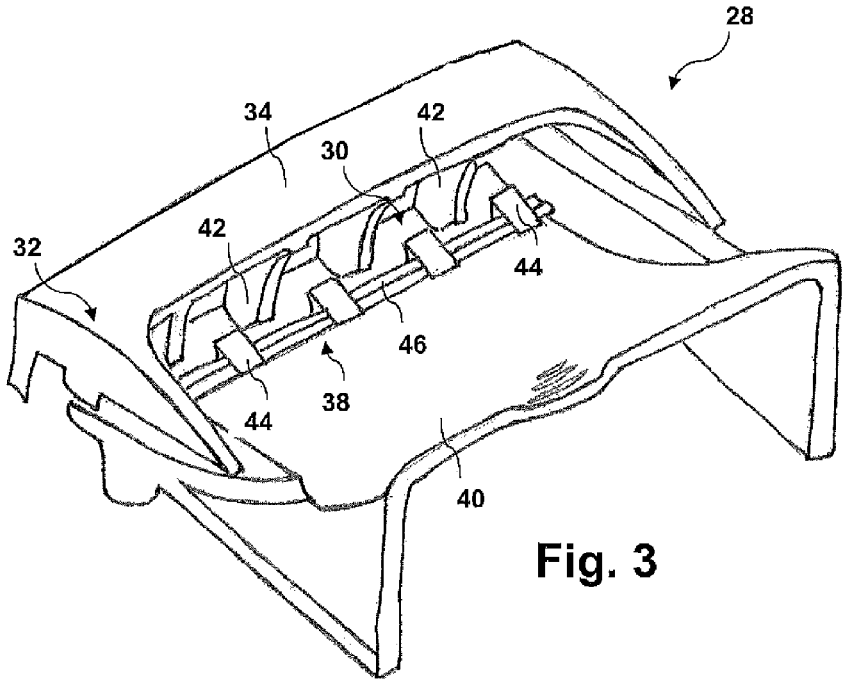
FIG. 3 is a perspective view of an embodiment of discharge assembly components that may be used with a printer terminal.
Figure 4:
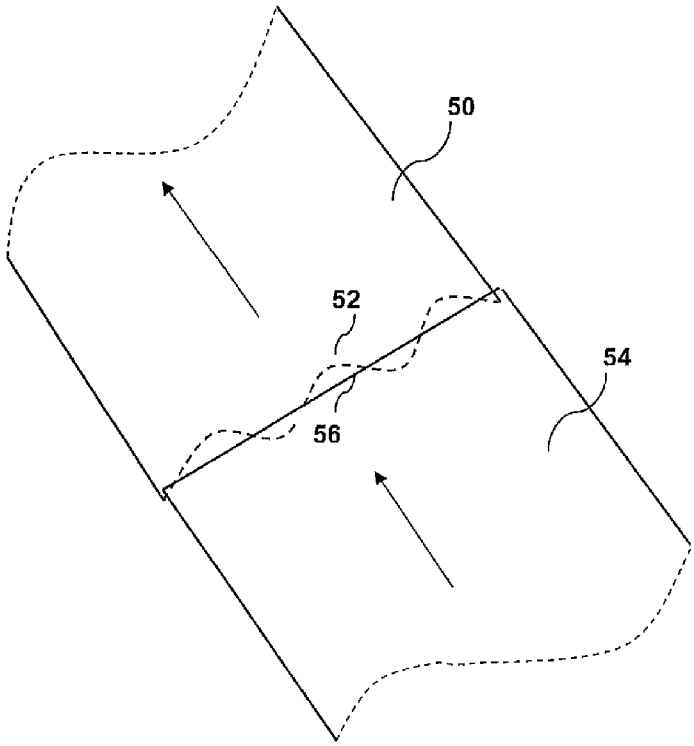
FIG. 4 is a diagrammatic view illustrating adjacent the principle of adjacent sheets or tickets being moved in accordance with principles of the invention.

FIG. 3 illustrates an embodiment of a discharge assembly 28 that utilizes a first member 32 and a second member 38. The first member 32 is a cover member that can pivot relative to the second member 38, with the gap 30 defined between the two members. A plurality of protruding members 42 are disposed on the underside of the cover 34, and a plurality of opposed protruding members 44 are provided on the second member 38. The protruding members 44 are spaced between the opposed protruding members 42 such that a serpentine or sinusoidal transverse profile is induced in the trailing edge 52 of the first sheet 50, as illustrated in FIG. 4. As in FIG. 3, the protruding members 44 may be mounted on a rod 46 that extends across the gap 30. This rod 46 may be rotatable and biased into the gap 30 by a spring element, or other suitable torsion mechanism. In an alternative embodiment, the rod 46 and attached protruding members 44, are biased into the gap 30 simply by gravity. In other words, the rod 46 is rotatable, and the weight and configuration of the protruding members 44 on the rod cause the rod to rotate into the gap 30.

In the embodiment of FIG. 3, the discharge assembly 28 also includes a discharge tray 40 into which the stack of tickets 16 is accumulated.

FIG. 4 graphically illustrates the operational principle of moving the first ticket 50 by engaging a flat or straight profile leading edge 56 of a subsequent ticket 54 against a sinusoidal or serpentine profile of the trailing edge 52 of the first ticket 50. As the second ticket 54 is advanced, as indicated by the arrow, it engages or bisects the serpentine profile of the trailing edge 52 and thus pushes the ticket 50 in the direction of the arrow.

Figure 5A:
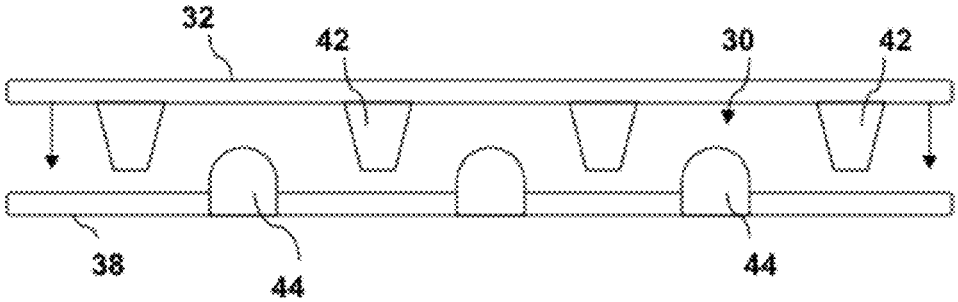
FIGS. 5A through 5C are side diagrammatic views of various embodiments of discharge assembly components.
Figure 5B:
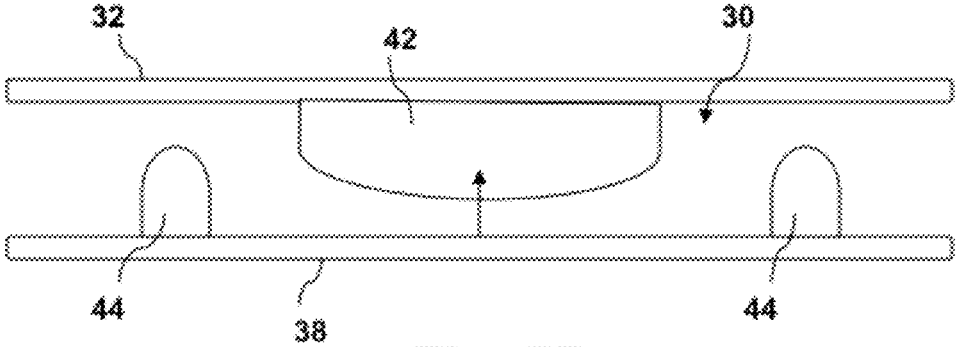
Figure 5C:
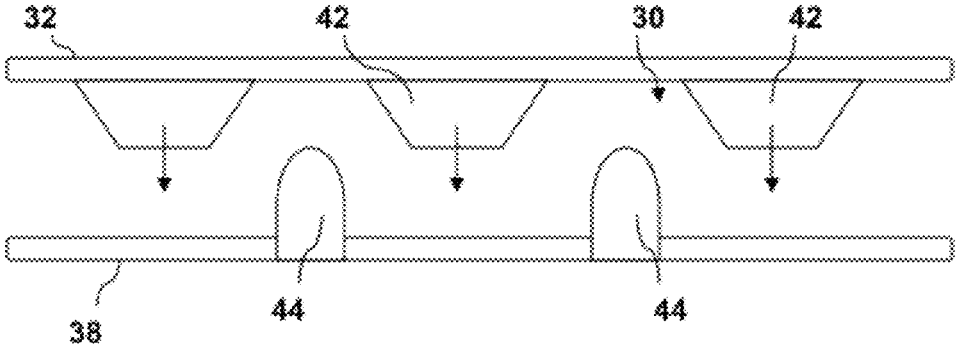

FIGS. 5A through 5C illustrate various possible embodiments for defining a gap 30 between different structural members of a discharge assembly. In FIG. 5A, the protruding members 44 are disposed on stationary structure, such as a second member 38. The stationary structure 38 may be any type of suitable support for the protruding members 44. The members 44 are spaced between opposed protruding members 42 that are provided across a first member 32. As discussed, the first member 32 may be a component of a cover member in a clamshell configuration. The arrows extending from the first member 32 indicate that this member is biased into the gap 30, whereas the second member 38 is stationary. The configuration of protruding members 42, 44 as in FIG. 5A will produce a serpentine or sinusoidal transverse profile on the trailing edge 52 of the first ticket 50 (FIG. 4).

In the embodiment of FIG. 5B, an elongated protruding member 42 extends from a stationary first member 32. Protruding members 44 on each side of the protruding member 42 are provided on a member 38 that is biased into the gap 30, as illustrated by the arrow. The configuration of protruding members 42, 44 in this embodiment will produce a generally continuously curved profile on the trailing edge 52 of the first ticket 50.

In the embodiment of FIG. 5C, the protruding members 42 are provided on a stationary first member 32, and the protruding members 44 are provided on a stationary second member 38. Each of the individual protruding members 42 are individually biased relative to the first member 32, as illustrated by the individual arrows. Each protruding member 42 may, for example, be pivotal relative to the first member 32, which may be a rod or other elongated member, by any conventional biased mechanism, such as a torsion spring, and the like. The configuration of protruding members 42, 44 in FIG. 5C will also produce a serpentine or sinusoidal profile on the trailing edge 52 of the first ticket 50.

It should be readily appreciated by those skilled in the art that the various embodiments illustrated and described herein are presented for sake of illustration and explanation of the invention, and are not limitations of the invention. Modifications and variations can be made to the various embodiments as described and illustrated herein that come within the scope and spirit of the appended claims.

What is claimed is:

1. A printer configured for printing individual sheets from a continuous feed roll, comprising:

a housing configured for receipt of a feed roll of sheet material;

a print mechanism disposed within said housing, whereby the sheet material is conveyed within said housing to said print mechanism;

a sheet separating device disposed within said housing downstream of said print mechanism to separate the sheet material into individual printed sheets;

a discharge assembly disposed downstream of said sheet separating device, said discharge assembly defining a gap extending across the conveying path of the sheet material through which the sheet material is advanced;

a plurality of opposed protruding members disposed in said gap at a position so as to contact and deflect the sheet material as the sheet material moves through said gap, and to impart a curved transverse profile to a trailing edge of a first individual sheet held in said gap;

whereby a leading edge of a subsequent second individual sheet bisects the curved trailing edge of the first individual sheet and pushes the first individual sheet out of said gap as the second individual sheet is advanced through said print mechanism; and said discharge assembly further comprising a discharge tray that defines a stationary component of said gap, at least one of said protruding members disposed on said discharge tray.

2. The printer as in claim 1, wherein said discharge assembly is formed integral with said housing.

3. The printer as in claim 1, wherein at least one of said protruding members is spring-biased into said gap.

4. The printer as in claim 1, said discharge assembly further comprising a cover member that pivots from a closed position to an open position relative to said housing, said cover member defining said gap in said closed position.

5. The printer as in claim 1, wherein said printer is configurable with a lottery ticket terminal.

6. A printer configured for printing individual sheets from a continuous feed roll, comprising:

a housing configured for receipt of a feed roll of sheet material;

a print mechanism disposed within said housing, whereby the sheet material is conveyed within said housing to said print mechanism;

a sheet separating device disposed within said housing downstream of said print mechanism to separate the sheet material into individual printed sheets;

a discharge assembly disposed downstream of said sheet separating device, said discharge assembly defining a gap extending across the conveying path of the sheet material through which the sheet material is advanced;

at least one protruding member disposed in said gap at a position so as to contact and deflect the sheet material as the sheet material moves through said gap, and to impart a curved transverse profile to a trailing edge of a first individual sheet held in said gap;

whereby a leading edge of a subsequent second individual sheet bisects the curved trailing edge of the first individual sheet and pushes the first individual sheet out of said gap as the second individual sheet is advanced through said print mechanism; and wherein said discharge assembly comprises a first member and a second opposed member with said gap defined between said members and said protruding member configured on one of said first or second members, at least one of said first or second members being biased towards the other respective said member such that a trailing portion of the first individual sheet is held between said first and second members with the trailing edge of the first individual sheet presented to the leading edge of the second individual sheet.

7. The printer as in claim 6, wherein one of said first or second members is stationary, and the other respective member is biased towards said stationary member.

8. The printer as in claim 7, comprising a plurality of said protruding members spaced apart and extending into said gap, at least one of said protruding members disposed on said stationary member, and at least one of said protruding members disposed on said biased member.

9. The printer as in claim 8, wherein said protruding members are disposed so as to impart a serpentine transverse profile to the trailing edge of the first individual sheet.

10. The printer as in claim 6, further comprising a cover that moves from a closed position to an open position relative to said housing, one of said first or second members defined by said cover.

11. A printer configured for printing individual sheets from a continuous feed roll, comprising:

a housing configured for receipt of a feed roll of sheet material;

a print mechanism disposed within said housing, whereby the sheet material is conveyed within said housing to said print mechanism;

a sheet separating device disposed within said housing downstream of said print mechanism to separate the sheet material into individual printed sheets;

a discharge assembly disposed downstream of said sheet separating device, said discharge assembly including a cover member that pivots from a closed position to an open position relative to said housing, in the closed position said discharge assembly defining a gap extending across the conveying path of the sheet material through which the sheet material is advanced;

at least one protruding member disposed in said gap at a position so as to contact and deflect the sheet material as the sheet material moves through said gap, and to impart a curved transverse profile to a trailing edge of a first individual sheet held in said gap;

whereby a leading edge of a subsequent second individual sheet bisects the curved trailing edge of the first individual sheet and pushes the first individual sheet out of said gap as the second individual sheet is advanced through said print mechanism; and wherein said protruding member is defined on an underside of said cover member and is spring-biased into said gap so as to urge the sheet material against said protruding member.

12. The printer as in claim 11, further comprising a plurality of said spring-biased protruding members disposed on said cover member across said gap so as to define a serpentine path for the sheet material through said gap.

* * * * *